US011073147B2

(12) United States Patent
Brett et al.

(10) Patent No.: US 11,073,147 B2
(45) Date of Patent: Jul. 27, 2021

(54) MEASURING HYDRAULIC FLUID PRESSURE IN A FLUID-WORKING MACHINE

(71) Applicant: ARTEMIS INTELLIGENT POWER LIMITED, Midlothian (GB)

(72) Inventors: Mark Brett, Midlothian (GB); Peter McCurry, Midlothian (GB)

(73) Assignee: ARTEMIS INTELLIGENT POWER LIMITED, Midlothian (GB)

( * ) Notice: Subject to any disclaimer, the term of this patent is extended or adjusted under 35 U.S.C. 154(b) by 175 days.

(21) Appl. No.: 16/138,276

(22) Filed: Sep. 21, 2018

(65) Prior Publication Data

US 2019/0154030 A1 May 23, 2019

(30) Foreign Application Priority Data

Nov. 17, 2017 (EP) ..... 17202461

(51) Int. Cl.

| | |
|---|---|
| ***F04B 51/00*** | (2006.01) |
| ***F04B 49/06*** | (2006.01) |
| ***F04B 7/00*** | (2006.01) |
| ***F04B 53/10*** | (2006.01) |
| *F03C 1/00* | (2006.01) |

(52) U.S. Cl.

CPC ..... *F04B 49/065* (2013.01); *F04B 7/0076* (2013.01); *F04B 51/00* (2013.01); *F04B 53/1082* (2013.01); *F03C 1/002* (2013.01); *F04B 7/00* (2013.01); *F04B 2205/03* (2013.01)

(58) Field of Classification Search

CPC F04B 49/065; F04B 2205/03; F04B 2205/02; F04B 2205/04; F04B 2205/05

See application file for complete search history.

(56) References Cited

U.S. PATENT DOCUMENTS

| | | | | |
|---|---|---|---|---|
| 2,477,999 | A | 8/1949 | Miller | |
| 5,947,140 | A * | 9/1999 | Aardema | F15B 21/087 137/1 |
| 6,086,336 | A | 7/2000 | Welschof et al. | |
| 6,116,871 | A | 9/2000 | Bracke et al. | |
| 6,164,933 | A | 12/2000 | Tani et al. | |
| 6,293,757 | B1 | 9/2001 | Oda et al. | |
| 6,456,921 | B1 * | 9/2002 | Bodie | B60T 13/662 701/70 |
| 8,117,836 | B2 * | 2/2012 | Mori | F04C 28/24 60/409 |

(Continued)

FOREIGN PATENT DOCUMENTS

| | | |
|---|---|---|
| EP | 3 121 444 | 7/2015 |
| JP | 20090103007 | 5/2009 |
| WO | 2013/118180 | 8/2013 |

*Primary Examiner* — Dustin T Nguyen

(74) *Attorney, Agent, or Firm* — Hauptman Ham, LLP

(57) ABSTRACT

A measurement of the pressure of hydraulic fluid in a fluid working machine can be determined from the timing of the movement of valves which selectively seal a working chamber of cyclically varying volume from a fluid gallery. The timing of opening of a low pressure valve, to connect a working chamber to a low pressure fluid gallery, following the closure of a high pressure valve to seal a working chamber can be used to estimate the pressure in the high pressure fluid gallery at the moment of closure of the high pressure valve.

16 Claims, 8 Drawing Sheets

(56) References Cited

U.S. PATENT DOCUMENTS

| | | | | |
|---|---|---|---|---|
| 8,515,643 | B2 * | 8/2013 | Rubenbauer | B60T 8/36 701/70 |
| 8,631,688 | B1 * | 1/2014 | Rayl | F01L 9/10 73/114.33 |
| 9,488,163 | B2 * | 11/2016 | Caldwell | F04B 1/00 |
| 2001/0031203 | A1 * | 10/2001 | Schroeder | F04B 39/1033 417/63 |
| 2005/0179185 | A1 * | 8/2005 | Song | B60G 17/0155 267/218 |
| 2006/0201244 | A1 | 9/2006 | Metzler et al. | |
| 2011/0268590 | A1 * | 11/2011 | Stein | F04B 49/24 417/298 |
| 2012/0059524 | A1 * | 3/2012 | Caldwell | F04B 49/22 700/282 |
| 2012/0063919 | A1 | 3/2012 | Rampen et al. | |
| 2012/0203447 | A1 | 8/2012 | Kammerstetter | |
| 2012/0297867 | A1 | 11/2012 | Kammerstetter et al. | |
| 2013/0110418 | A1 * | 5/2013 | Nousiainen | F16K 37/0083 702/50 |
| 2015/0266460 | A1 * | 9/2015 | Benesh | F16D 65/0043 73/39 |
| 2016/0138393 | A1 | 5/2016 | Kyllingstad et al. | |
| 2016/0177937 | A1 * | 6/2016 | Liu | F04B 17/042 417/44.2 |
| 2017/0089291 | A1 | 3/2017 | Suzuki | |

* cited by examiner

MEASURING HYDRAULIC FLUID PRESSURE IN A FLUID-WORKING MACHINE

RELATED APPLICATIONS

The present application claims the priority of European Application No. 17202461.4, filed Nov. 17, 2017, which is incorporated herein by reference in its entirety.

FIELD OF THE INVENTION

The invention relates to the measurement of pressure in hydraulic fluid working machines which comprise at least one working chamber of cyclically varying volume which communicates with first and second fluid galleries through valves.

BACKGROUND TO THE INVENTION

Hydraulic fluid working machines include fluid-driven and/or fluid-driving machines, such as pumps, motors, and machines which can function as either a pump or as a motor in different operating modes. When a fluid working machine operates as a pump, a lower pressure fluid gallery typically acts as a net source of fluid and a higher pressure gallery typically acts as a net sink for fluid. When a fluid working machine operates as a motor, a higher pressure gallery typically acts as a net source of fluid and a lower pressure gallery typically acts as a net sink for fluid.

Fluid working machines are known which comprise a plurality of working chambers of cyclically varying volume, in which the displacement of fluid through the working chambers is regulated by electronically controllable valves, on a cycle by cycle basis and in phased relationship to cycles of working chamber volume, to determine the net throughput of fluid through the machine. For example, EP 0 361 927 disclosed a method of controlling the net throughput of fluid through a multi-chamber pump by opening and/or closing electronically controllable poppet valves, in phased relationship to cycles of working chamber volume, to regulate fluid communication between individual working chambers of the pump and a lower pressure gallery. Valves which regulate the flow of fluid between a lower pressure gallery and a working chamber are referred to herein as low pressure valves. As a result, individual chambers are selectable by a controller, on a cycle by cycle basis, to carry out an active cycle and displace a predetermined fixed volume of fluid or to undergo an inactive cycle with no net displacement of fluid, thereby enabling the net throughput of the pump to be matched dynamically to demand.

EP 0 494 236 developed this principle and included electronically controllable poppet valves which regulate fluid communication between individual working chambers and a higher pressure gallery, thereby facilitating the provision of a fluid working machine functioning as either a pump or a motor in alternative operating modes. Valves which regulate the flow of fluid between a higher pressure gallery and a working chamber are referred to herein as high pressure valves. EP 1 537 333 introduced the possibility of part cycles, allowing individual cycles of individual working chambers to displace any of a plurality of different volumes of fluid to better match demand, thereby enabling active cycles to have selected net displacements. GB 2430246 introduced a type of valve for regulating fluid communication between individual working chambers and a higher pressure gallery, and a method of operating a machine with such a valve, that allowed the fluid working machine of EP 0 494 236 to develop a torque when stationary.

With these and other high performance fluid working machines, it is typical to measure the pressure of hydraulic working fluid within the machine, especially the pressure of the working fluid in the higher pressure fluid gallery. In some embodiments, the lower pressure fluid gallery is at a generally constant pressure (e.g. atmospheric). The measurement of pressure is useful in order to facilitate fine control of the machines. For example, the pressure in the higher pressure fluid gallery affects the shaft torque exerted through the piston/cylinder arrangements which define the working chambers. This torque is generally proportional to the frequency of cycles of working chamber volume multiplied by the pressure differential between the fluid galleries multiplied by the net volume of hydraulic fluid displaced between the fluid galleries during cycles of working chamber volume. Pressure measurements can also be useful to diagnose faults or to control feedback loops to retain pressure within set bounds.

The requirement to measure pressure is usually met by providing pressure transducers in contact with the working fluid. However, appropriate high performance transducers can be expensive, can struggle to survive for the required service life of the hydraulic machine, can be prone to failure or present a possible failure mode or require maintenance, and can require additional wiring, increasing the complexity of machines. The invention seeks to avoid these problems associated with the use of pressure transducers.

WO 2011/104547 (Rampen et al.) disclosed the monitoring of the opening or closing of a valve associated with a working chamber of a fluid working machine in order to measure properties of entrained gas within a working chamber. The pressure in the low and higher pressure galleries was measured continuously using pressure transducers.

SUMMARY OF THE INVENTION

According to a first aspect of the invention there is provided a method of estimating the pressure of hydraulic fluid in a fluid working machine, the fluid working machine comprising a working chamber of cyclically varying volume, first and second hydraulic fluid galleries, a first valve which regulates the flow of hydraulic fluid between the working chamber and the first fluid gallery and a second valve which regulates the flow of hydraulic fluid between the working chamber and the second fluid gallery, the method comprising detecting an event indicative of the opening or closing of the first valve to bring the working chamber into or out of fluid communication with the first fluid gallery (respectively) and estimating the said pressure from the timing of the said detected event.

It may be that the estimated pressure is the pressure of hydraulic fluid in the second fluid gallery or in the working chamber, typically when the second valve closes, so that the working chamber is sealed from both the first and second fluid galleries, until the next time that the first valve opens.

Typically, when the second valve closes, the first valve is already closed and so the closure of the second valve seals the working chamber from the first and second fluid galleries. Typically the working chamber is thereby entirely sealed from when the second valve closes until the first valve opens.

It may be that the working chamber carries out a pumping cycle in which:

the second valve is connected to the fluid gallery which is at highest pressure (of the first and second fluid galleries, i.e. the higher pressure gallery) and the first valve is connected to the fluid gallery which is at lower pressure (the lower pressure gallery), and in which:

the second valve closes at around top dead centre to seal the working chamber from the higher pressure gallery and the detected event is indicative of the subsequent opening of the first valve directly after top dead centre to draw hydraulic fluid in from the lower pressure gallery.

It may be that the working chamber carries out a motoring cycle in which:

the second valve is connected to the fluid gallery which is at highest pressure (of the first and second fluid galleries, i.e. the higher pressure gallery) and the first valve is connected to the fluid gallery which is at lower pressure (the lower pressure gallery), and in which:

the second valve is closed before bottom dead centre to seal the working chamber from the higher pressure gallery and the detected event is indicative of the subsequent opening of the first valve directly at around bottom dead centre to vent hydraulic fluid to the lower pressure gallery.

We have found that the timing of the said opening of the first valve is indicative of the pressure in the higher pressure gallery, although this is counterintuitive as the first valve is connected to the lower pressure gallery and not the higher pressure gallery. When the second valve closes, the pressure in the working chamber at that time directly affects the timing of the next opening of the first valve.

Within this description and the appended claims, the terms "higher pressure gallery" and "lower pressure gallery" are relative, with the relative pressures being determined by the application. Typically the first and second galleries are, in either order, higher and lower pressure galleries. It may be that the first gallery is the lower pressure gallery and the second gallery is the higher pressure gallery, or vice versa, and this may swap during operation.

Nevertheless, it may be that the pressure (i.e. the said estimated pressure of hydraulic fluid in a fluid working machine) is the pressure of hydraulic fluid in the first fluid gallery or in the working chamber when the first valve opens or the first valve closes. The pressure in the first fluid gallery affects the timing of the passive opening or closing of the first valve, within cycles of working chamber volume. It is not necessary to know the pressure in the first gallery because typically this varies only by a small margin. This margin is easily distinguished, meaning there is a small effect on the estimate, and can typically be discounted in making the estimate.

It may be that the pressure (i.e. the said estimated pressure of hydraulic fluid in a fluid working machine) is the pressure of hydraulic fluid in the first fluid gallery or in the working chamber when the second valve opens or the second valve closes. The pressure in the first fluid gallery affects the timing of the passive opening or closing of the second valve, within cycles of working chamber volume, which in turn affects the timing of the opening or closing of the first valve. However, for this it is necessary to know the pressure in the second fluid gallery.

The estimated pressure may be absolute pressure however the estimated pressure may be relative pressure (e.g. relative to atmospheric pressure, relative to an unknown baseline pressure etc.)

It may be that the first valve comprises a valve member. The event may be indicative of the opening or closing of the first valve is the physical movement of the valve member, said movement detected by a sensor.

The sensor may for example be an optical sensor, acoustic sensor, piezoelectric sensor etc.

The first valve may comprise a main valve member and a pilot valve member in which case the event indicative of the opening or closing of the first valve may be indicative of the opening or closing of the main valve member or the pilot valve member.

It may be that the first valve comprises a valve member and the event indicative of the opening or closing of the first valve is the generation of an electrical signal resulting from movement of the valve member.

It may be that the first valve comprises a valve member and the event indicative of the opening or closing of the first valve is the generation of an electrical signal resulting from movement of a component of the first valve, other than the valve member, which component moves before the first valve opens or closes. The component may for example comprise an armature.

It may be that the first valve is a solenoid valve having a solenoid comprising a movable armature coupled to the valve member and comprising a solenoid coil. The electrical signal may be induced in the solenoid coil by movement of the armature relative to the solenoid coil due to movement of the valve member.

In some solenoid valves, a moveable armature is fixedly coupled to the valve member. However, there are solenoid valves such as those disclosed in EP 2329172 where the armature and valve member are not fixedly coupled, e.g. are coupled through springs or the armature bears on the valve member when it moves in one direction but not the other.

It may be that the opening or closing of the first valve is opening of the first valve caused by a reduction in pressure in the working chamber during an expansion stroke.

The first valve may be biased open or closed, for example with one or more springs and/or using an actuator (e.g. a solenoid actuator). However, in such embodiments, the first valve typically opens responsive to the net force on the valve member this net force is a resolution of force due to the pressure differential between the working chamber and the first fluid gallery and a resolution of force arising from any biasing change (arising from an actuator and/or biasing member such as a spring) from a direction in which the valve member is held closed to a direction in which the valve member opens and overcomes any stiction. The expansion stroke is simply the cycle portion between Top Dead Centre and Bottom Dead Centre, in which the volume of the working chamber expands.

It may be that the opening or closing of the first valve is the closing of the first valve caused by a reduction in pressure in the working chamber during an expansion stroke.

For example, during the expansion stroke of a pumping cycle, in which hydraulic fluid is still being received from a first fluid gallery (in this case, the higher pressure gallery), the pressure in the first fluid gallery affects the timing of the closing of the first valve (in this case, the HPV).

It may be that the said timing is the phase, within cycles of working chamber volume, of the said event.

The absolute value of the phase of the event (relative to an arbitrary zero) may be taken into account. The said timing may be the phase difference between the event and another event, such as an opening or closing of the second valve, before or after the said opening or closing of the first valve.

It may be that the said event is detected during each cycle, or at least each cycle during which the event takes place.

It may be that the said estimation of the pressure takes into account the timing of the detection of the event during only some cycles of working chamber volume, for example, during active cycles in which the working chamber makes a net displacement of working fluid (e.g. full mode cycles and/or partial mode cycles).

It may be that the first valve is an electronically controlled valve. The first valve is typically a face sealing valve. The second valve may also be an electronically controlled valve. The second valve is typically a face sealing valve. Typically, the at least one electronically controlled valve is actively controlled to select the net displacement of hydraulic fluid by the working chamber on each cycle of working chamber volume. The net displacement may be selected responsive to a received demand signal, indicative of a target property associated with the displacement of hydraulic fluid (such as volume displaced, pressure of hydraulic fluid at a location (such as an output of the machine), position of an actuator in hydraulic communication with a said gallery etc.).

Typically, the fluid working machine comprises a rotatable shaft speed or position sensor and the method comprises actively controlling the electronically controlled valve in phased relationship with cycle of working chamber volume using the sensed measurement of the speed or position sensor. Typically, the machine comprises a rotatable shaft and the volume of the working chamber varies cyclically with rotation of the rotatable shaft.

It may be that the estimation of the said pressure from the timing of the said detected event takes into account at least one other parameter.

The estimation may be carried out by a hardware processor executing an algorithm. The estimate may be carried out using an algorithm and/or stored data which takes into account at least one parameter other than the said timing. The stored data may comprise a look-up table. The estimate may be carried out (e.g. using said algorithm) taking into account at least one variable, other than a property of the said opening or closing of the first valve, measured by a sensor during operation. The variable may be temperature (e.g. of the hydraulic fluid or of one or more components of the machine) and the sensor may be a temperature sensor. The variable may be the viscosity of the hydraulic fluid. The sensor may be a viscosity sensor. The variable may be a property of (e.g. the amount of) entrained gas within hydraulic fluid. The variable may be the frequency of cycles of working chamber volume. The sensor may be a shaft speed sensor which measures the speed of rotation of the shaft to which cycles of working chamber volume are coupled. The estimation is typically calibrated. Calibration may have been carried out using a pressure sensor to measure the pressure of hydraulic fluid which is estimated in use.

It may be that the estimate of the said pressure deduced from the timing of the said detected event takes into account pressure oscillations (e.g. ringing) within the second fluid gallery, for example caused by closure of the second valve.

It may be that the estimate of the said pressure from the timing of the said detected event takes into account properties (which may be measured by at least one sensor in use) of a hydraulic circuit portion in fluid communication with the first fluid gallery.

It may be that the estimate of the said pressure from the timing of the said detected event takes into account a measurement of the position or, or load acting on, a hydraulic actuator in fluid communication with the first fluid gallery.

The pressure or load acting on such an actuator (or the position of the actuator) can affect the opening or closing time of the first valve, for example by affecting the compliance (relationship between change in hydraulic pressure with contained hydraulic fluid volume) of a hydraulic circuit portion in fluid communication or in selective communication with the first fluid gallery.

It may be that the pressure is estimated taking into account the timing of the said detected event during only some cycles of working chamber volume.

It may be that the pressure is estimated taking into account the timing of the said detected event only during cycles in which the working chamber carries out an active cycle leading to a net displacement of working fluid from the first fluid gallery to the second fluid gallery or vice versa.

It may be that the fluid working machine comprises a plurality of said working chambers which are in fluid communications with the same said first and second fluid galleries, each working chamber having a said first valve which regulates the flow of hydraulic fluid between the working chamber and the first fluid gallery and a said second valve which regulates the flow of hydraulic fluid between the working chamber and the second fluid gallery, wherein the method comprising detecting an event indicative of the opening or closing of the first valves to bring the respective working chamber into or out of fluid communication with the first fluid gallery (respectively) and estimating the said pressure from the timing of the said detected event.

Thus the pressure (e.g. in the second fluid gallery) may be measured more frequently than cycles of working chamber volume.

The method may comprise carrying out an active cycle in order to generate an opening or closing (as appropriate), to enable pressure estimation when the fluid working machine is otherwise predominantly or only carrying out inactive cycles without opening and closing of the first valve.

In a second aspect, the invention extends to a fluid working machine comprising a working chamber of cyclically varying volume, first and second hydraulic fluid galleries, a first valve which regulates the flow of hydraulic fluid between the working chamber and the first fluid gallery and a second valve which regulates the flow of hydraulic fluid between the working chamber and the second fluid gallery, and a controller, the controller configured to estimate a pressure of working fluid in the fluid working machine by detecting and measuring the timing of an event indicative of the opening or closing of the first valve to bring the working chamber into or out of fluid communication with the first fluid gallery (respectively) and processing the (measured) timing of the said detected event to estimate the pressure.

The controller may do so by the method of the first aspect of the invention. Optional features mentioned above in respect of the first aspect of the invention are also optional features of the second aspect of the invention.

DESCRIPTION OF THE DRAWINGS

An example embodiment of the present invention will now be illustrated with reference to the following Figures in which.

DETAILED DESCRIPTION OF AN EXAMPLE EMBODIMENT

Figure 1:
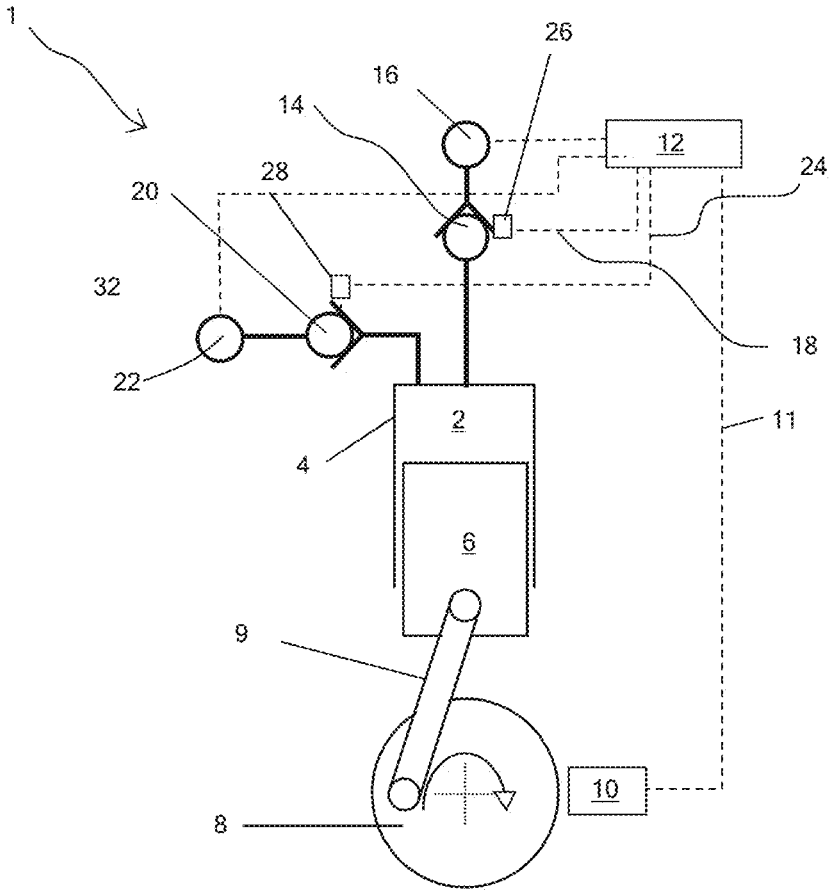
FIG. 1 is a schematic diagram of an individual working chamber of a fluid working machine.

A fluid working machine 1 operable as a pump or motor includes a plurality of working chambers. FIG. 1 illustrates an individual working chamber 2 which has a volume defined by the interior surface of a cylinder 4 and a piston 6 which is driven from a crankshaft 8 by a crank mechanism 9 and which reciprocates within the cylinder to cyclically vary the volume of the working chamber. A shaft position and speed sensor 10 determines the instantaneous angular position and speed of rotation of the shaft, and informs a controller 12, by way of electrical connection 11, which enables the controller to determine the instantaneous phase of the cycles of each individual working chamber. The controller is typically a microprocessor or microcontroller which executes a stored program in use.

The working chamber comprises a low pressure valve (LPV) in the form of an electronically actuatable face-sealing poppet valve 14, which faces inwards toward the working chamber and is operable to selectively seal off a channel extending from the working chamber to a lower pressure gallery 16, which functions generally as a net source or sink of fluid in use. The LPV is a normally open solenoid closed valve which opens passively when the pressure within the working chamber is less than the pressure within the lower pressure gallery, during an intake stroke, to bring the working chamber into fluid communication with the first lower pressure gallery, but is selectively closable under the active control of the controller via a LPV control line 18 to bring the working chamber out of fluid communication with the lower pressure gallery. Alternative electronically controllable valves may be employed, such as normally closed solenoid opened valves.

The working chamber further comprises a high pressure valve (HPV) 20 in the form of a pressure actuated delivery valve. The HPV faces outwards from the working chamber and is operable to seal off a channel extending from the working chamber to a higher pressure gallery 22, which functions as a net source or sink of fluid in use. The HPV functions as a normally-closed pressuring-opening check valve which opens passively when the pressure within the working chamber exceeds the pressure within the higher pressure gallery. The HPV may also function as a normally-closed solenoid opened check valve which the controller may selectively hold open via a HPV control line 24 once the HPV is opened by pressure within the working chamber. Alternatively, the HPV may be openable under the control of the controller when there is pressure in the higher pressure gallery but not in the working chamber, or may be partially openable, for example only a portion of the HPV may be openable against a pressure difference, with the remaining portion openable when the pressure difference reduces.

Figure 8:
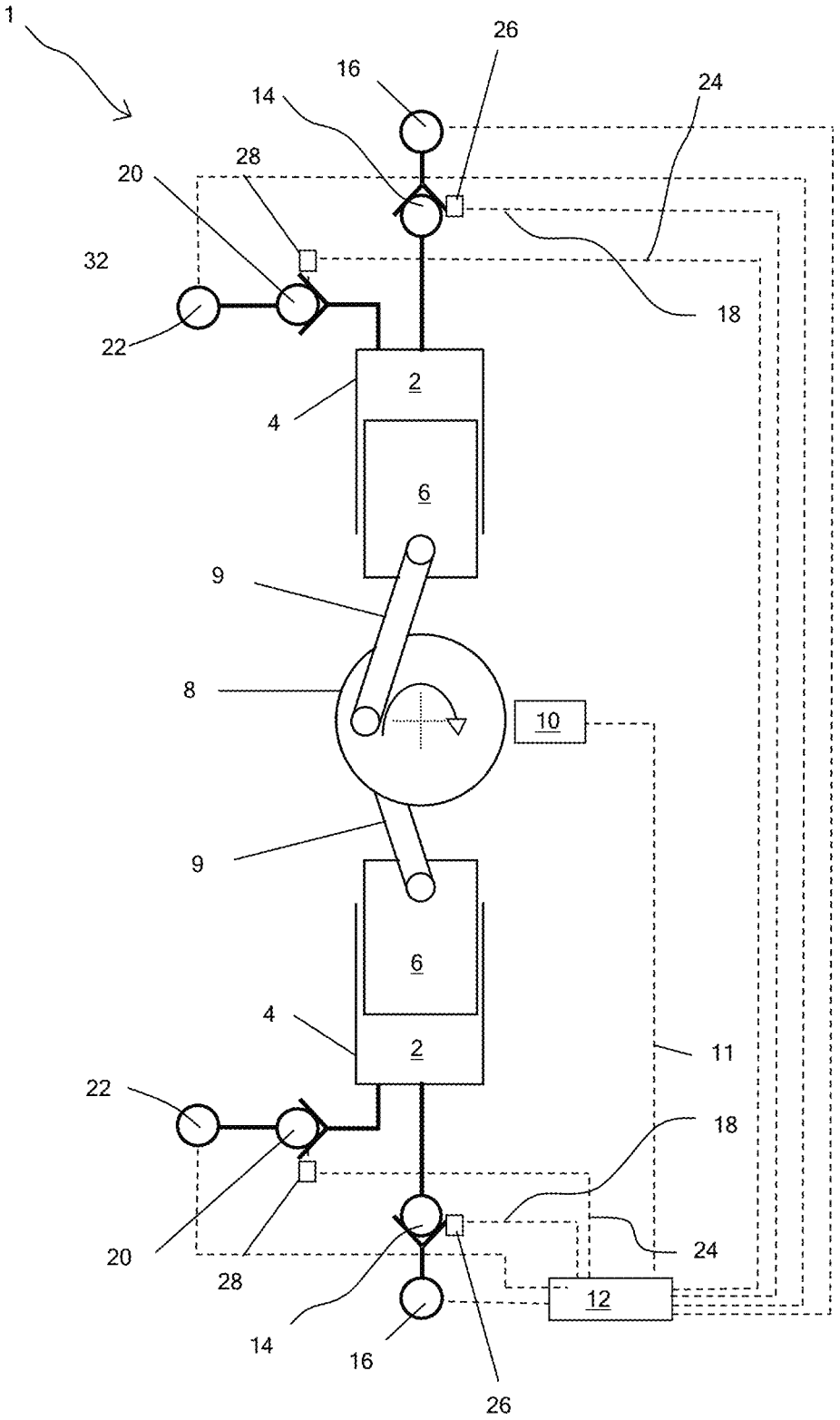
FIG. 8 is a schematic diagram of a plurality of working chamber of a fluid working machine.

FIG. 8 illustrates a plurality of working chamber of a fluid working machine. As shown in FIG. 8, the machine comprises a plurality of such working chambers 2, with corresponding LPVs and HPVs, through which the working chambers are connected to the lower pressure and higher pressure galleries. The galleries may include conduits which extend in a ring around the working chambers, to connect some or all of them to the same lower and higher pressure fluid galleries.

The LPV and HPV have LPV 26 and HPV 28 valve monitoring devices respectively which can detect opening, closing or speed of movement of the LPV and HPV, and communicate this information to the controller. In this example, the valve monitoring devices are incorporated into the valves themselves. The controller is operable to observe the character and timing of the valve movement signals relative to the timing and character of its commands to the LPV and/or HPV and also the shaft position and speed (and hence the working chamber volume and rate of change of volume).

As well as determining whether or not to close or hold open the primary low pressure valve on a cycle by cycle basis in the manner known from, for example, EP 0 361 927, EP 0 494 236, and EP 1 537 333, the controller is operable to vary the precise phasing of the closing of the LPV and HPV with respect to the varying working chamber volume during cycles for which it has been determined that the LPV and HPV should close.

Figure 2:
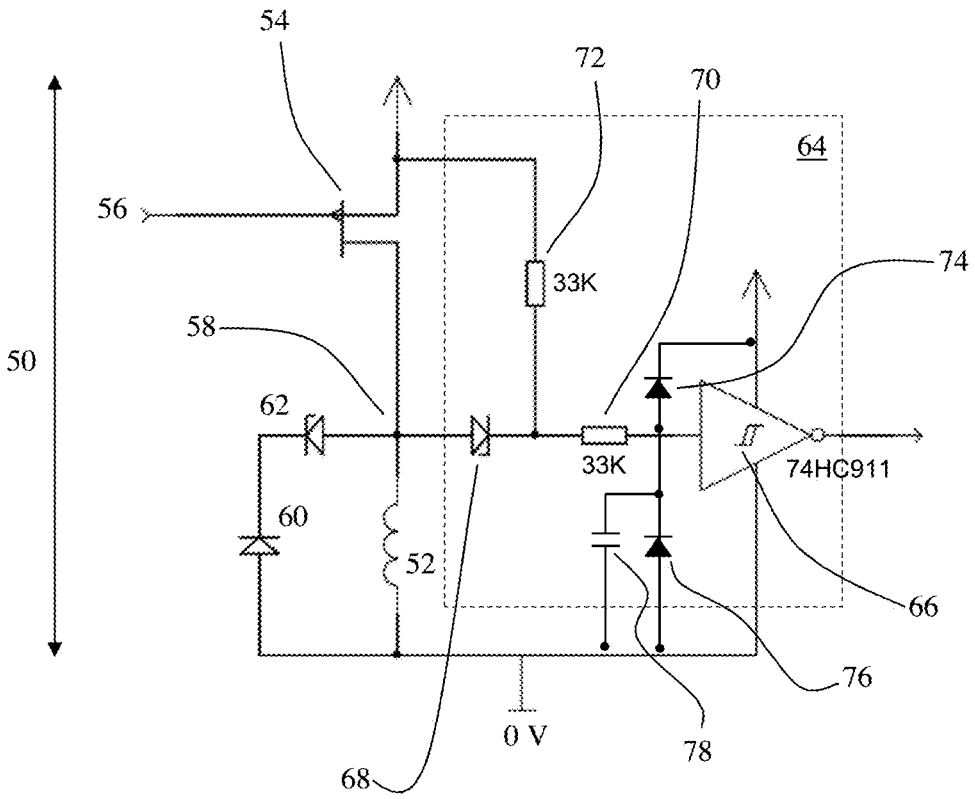
FIG. 2 is a schematic diagram of a valve monitoring electrical circuit.

FIG. 2 is a circuit diagram of a valve monitoring device for monitoring an actuated valve comprising an electromagnetic coil, in this example also incorporating an amplifier for driving more current into the coil than the controller would otherwise be capable of supplying. 12V power supply 50 is connected across coil 52 via a P-channel FET 54 (acting as the amplifier), the FET being under the control of the controller 12 (FIG. 1) via an interface circuit (not shown) connected at 56 and also connected to a sensed junction 58. A flywheel diode 60 and optional current-damping zener diode 62 in series provide a parallel current path around the coil. A valve monitoring circuit is shown generally at 64 and comprises an inverting Schmitt trigger buffer 66 driven by a level shifting zener 68 connected to the coil and FET node and biased by bias resistor 72, protected by protection resistor 70. The Schmitt trigger output signal is referenced to supply rails suitable for connection to the controller, and diodes 74, 76 (which may be internal to the Schmitt trigger device) protect the Schmitt trigger. An optional capacitor 78 between the Schmitt trigger input and the protection resistor acts (in conjunction with the protection resistor) as a low pass filter, and is useful in the event that noise (for example PWM noise) is expected.

In operation, the sensed junction sits at 0V and the bias resistor draws the Schmitt trigger's input to the level-shifting zener diode's value of 3V, driving the Schmitt trigger's output low. When the controller activates the FET to close or open the associated valve the sensed junction is at 12V, but the protection resistor protects the Schmitt trigger from damage and its output is still low. When the controller removes the activating signal, the sensed junction voltage falls to around −21V due to the flywheel diode and current-clamping zener diode and the inductive property of the coil. The protection resistor protects the Schmitt trigger from the −18V signal it will see after the level-shifting zener, but the Schmitt trigger now outputs a high signal. After the inductive energy dissipates, the Schmitt trigger output returns to a low value. However, if the valve begins to move, for example because it is no longer held closed by pressure, then the motion will produce through inductive effects a voltage across the coil, and hence a negative voltage at the sensed junction. The Schmitt trigger produces a high output which the controller can detect and/or measure, thus to detect the time, speed or presence of valve movement. The inductive voltage generated by the coil may be due to some permanent magnetism of the valve materials or some residual current circulating in the coil due to bias resistor 72.

The controller may need to disregard some high or low signals that it receives (or fails to receive, when expected) from the sensor. For example, voltage changes on either end of the coil 52 can cause false readings, including detecting valve movement when none has occurred and failing to detect valve movement when it has occurred. The controller therefore is preferably operable to selectively disregard signals which are received at unexpected times, or which are correlated with other events known to interfere with the correct and accurate measurement of valve movement. For example, the activation of other coils of a fluid working machine sharing a common 0V line with the coil 52 can raise the voltage at sensed junction 58. Thus, if the other coil is activated simultaneous to the movement of coil 52, the sensor may fail to detect the movement of coil 52 since the voltage at sensed junction 58 will not drop sufficiently low.

It will be appreciated that valve monitoring devices could be implemented in numerous ways and that, although in this example the valve monitoring device is integral to the valve, it may be physically separate to the valve and in wired communication with the valve solenoid. Other mechanisms of detecting the valve movement will present themselves to those skilled in the art, for example applying an exciting AC signal or pulses to the coil and detecting the change in inductance of the coil 52 as the valve moves, or incorporating a series or parallel capacitor to create an LC circuit the resonant frequency and Q factor of which change with valve position. Movement of the valve could be detected using an optical sensor, a piezeoelectric sensor, or a magnetic sensor, or an acoustic sensor (which detects acoustic vibrations arising from valve movement).

Figure 3:
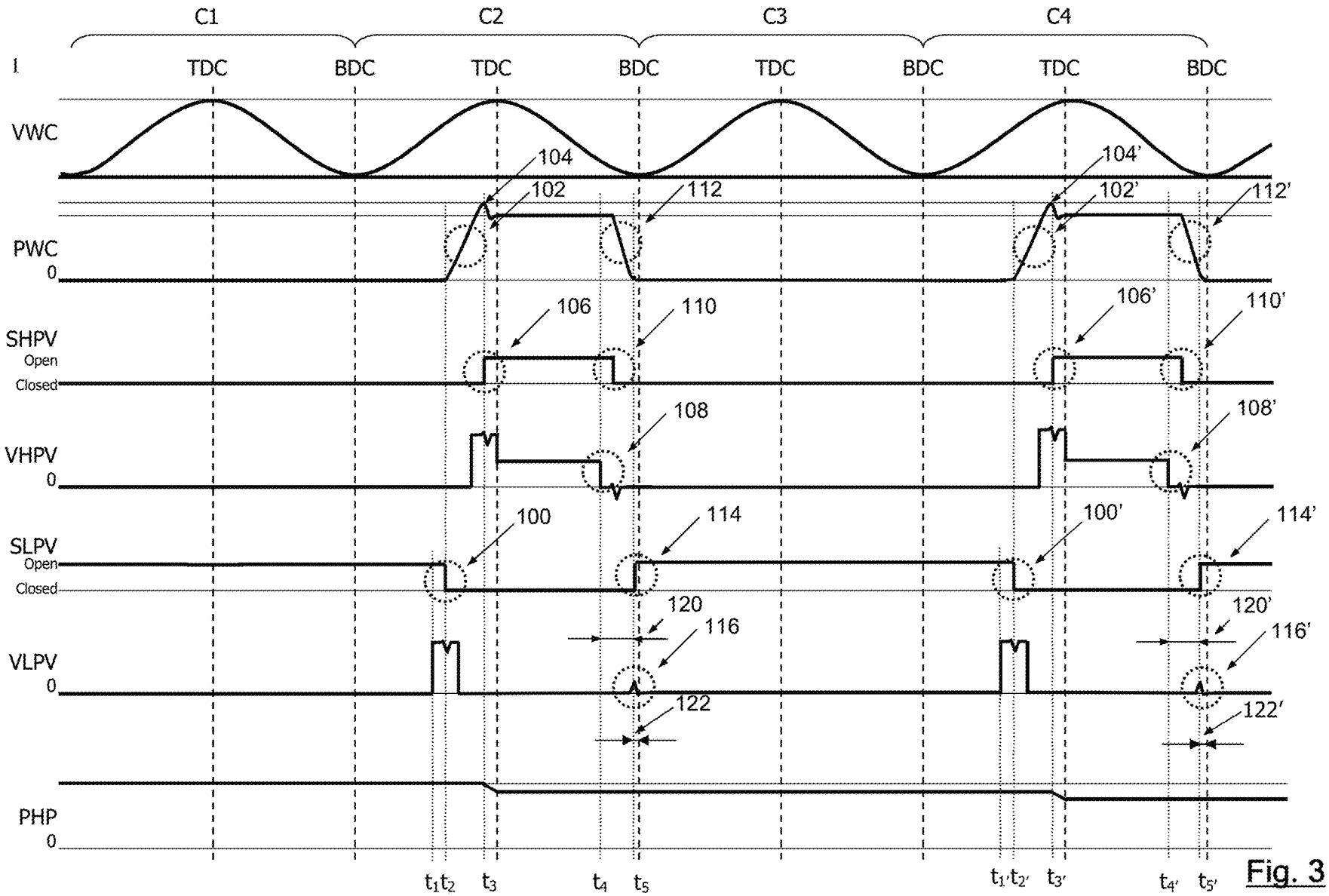
FIG. 3 is a timing diagram illustrating the status of the Low Pressure Valve (LPV), the High Pressure Valve (HPV), as well as the pressure within a working chamber during a series of motoring cycles; the y-axis represent phase, which is linear with time of the speed of rotation of the rotatable shaft is constant.

FIG. 3 is a timing diagram illustrating the piston 6 position relative to the cylinder 4 VWC (working chamber volume), the states SLPV and SHPV (open or closed) of the LPV 14 and HPV 20 respectively, as well as the pressure within the working chamber (PWC) and the average pressure in the higher pressure gallery (PHP) during a sequence of cycles of the fluid working machine working chamber shown in FIG. 1. The voltages VLPV and VHPV at the sensed junction 58 of the LPV and HPV respectively are also shown.

The x-axis in FIG. 3 is phase of working chamber volume. If the speed of rotation of the rotatable shaft is constant, then the rate of change of phase is constant over time. Timing can be measured either using phase or time in alternative implementations. Phase can be preferable in embodiments where the rotatable shaft may substantially change speed of rotation during normal operation. As is known in the art, the shaft speed and position sensor are monitored to constantly determine the phase at different times.

Throughout the first cycle C1, the low pressure valve is actively held open. Accordingly, hydraulic fluid is drawn in from the lower pressure gallery and exhausted to the lower pressure gallery. There is no net displacement of hydraulic fluid and minimum energy consumption. This is an inactive cycle.

During the second cycle C2, the controller determines to carry out an active motoring cycle. At time t1, late in the exhaust stroke and shortly before Top Dead Centre (TDC), the point of minimum working chamber volume, the controller activates the LPV coil (see trace VLPV) to begin a motoring cycle, the decision to do so being made according to any of the algorithms disclosed in any of the prior art documents which are hereby incorporated by reference. A short time later, t2, the LPV closes 100 (see trace SLPV) and working chamber pressure PWC builds 102 as the working chamber contracts, while the controller activates the HPV (trace VHPV) to hold it open.

Before the HPV opens 106 at t3, the pressure in the working chamber typically exceeds 104, the higher pressure gallery pressure (although this is not essential and depends on biasing, the force exerted by the HPV solenoid etc). The pressure of hydraulic fluid in the working chamber then tends towards the higher pressure gallery pressure as fluid flows in from the higher pressure gallery. The HPV closes passively (due to the effects Once the HPV opens at t3, the controller may choose to now partially activate the HPV as shown (for example by pulse wave modulation, PWM) to save power while maintaining the valve in its open position. Near the end of the intake stroke at t4 the controller deactivates 108 the HPV which closes 110 a short time later, at t5. Importantly, closure of the HPV seals hydraulic fluid in the working chamber. The amount (mass) of hydraulic fluid which is trapped will be related to the pressure of hydraulic fluid in the working chamber at the time of closure of the HPV, which is closely linked to the higher pressure gallery pressure (PHP). The working chamber pressure PWC falls 112 as the working chamber continues to expand and the time course of that pressure fall depends on the mass of hydraulic fluid trapped in the working chamber although it is also influenced by a number of factors such as temperature and the amount of entrained gas in the hydraulic fluid.

Next, the LPV opens 114 passively, when the pressure in the working chamber falls to a sufficiently low value. The LPV is typically biased open and so the pressure in the working chamber does not have to get quite as low as the LP gallery pressure (which is generally stable). As the LPV valve member moves, this leads to an induced current in the solenoid of the LPV and so a voltage peak 116 which is detected by the controller at time t5. This enables the controller to determine when the LPV opens.

Although in FIG. 3 voltage pulse 116 is shown as simultaneous to opening of the LPV, there may be a slight time difference, for example the peak voltage may occur when the LPV valve member is part way through its travel. In any event the voltage pulse is indicative of the opening of the LPV.

The timing of the opening of the LPV depends on the time course of the pressure fall in the working chamber since the closure of the HPV. Accordingly, the timing of the opening of the LPV is linked to the amount of hydraulic fluid trapped by the sealing of the working chamber arising from the preceding closure of the HPV, which is related to the pressure of working fluid in the higher pressure gallery. Thus, the timing of the voltage pulse is related to the pressure in the higher pressure gallery.

Referring back to FIG. 3, cycle C3 is a further inactive cycle in which the LPV is held open throughout. Cycle C4 is a further motoring cycle, which corresponds to cycle C2 except that the pressure in the higher pressure gallery (PHP) is a little lower. Corresponding features are labelled with the ' symbol. It can be seen that the phase of the LPV reopening 114', and so the timing of the voltage pulse 116' of the LPV solenoid, is slightly advanced as a direct result. This arises because there is less hydraulic fluid trapped in the working chamber and so the pressure drops more abruptly during the expansion phase.

The timing of the event associated with opening of the valve (in this case the voltage pulse associated with the opening of the LPV) is typically measured as a phase, to more readily adjust for variations in shaft speed, although it can equally be expressed as a time. The phase is measured relative to an event which takes place during each cycle, such as TDC or BDC (the phase difference between opening of the low pressure valve and BDC is shown as 122. 122'), and it does not matter whether that event is before or after the valve movement. The timing which is measured may also be a phase difference (or period of time) between two events, for example the period of time 120, 120' between closure of the HPV 110, 110' and the voltage pulse 116, 116'.

Figure 4:
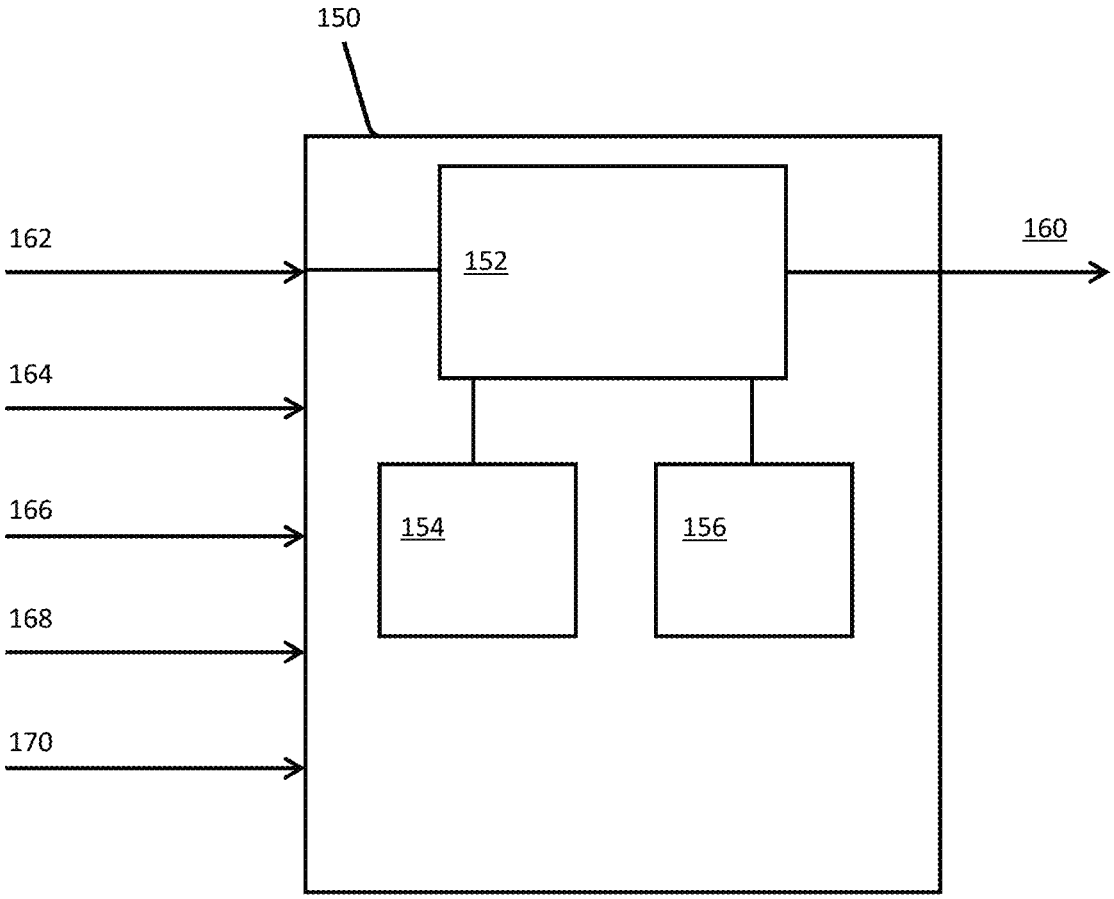
FIG. 4 is a block diagram of a controller processing a pressure estimate algorithm.

In practice a number of factors will affect the pressure and in a practical implementation, with reference to FIG. 4, a controller 150 comprises a processor 152 which is in communication with memory 154 storing computer program code to calculate an algorithm and memory storing calibration parameters 156 for the algorithm. The controller outputs a pressure estimate 160 (which is typically further processed by other program code executed by the same or another processor) taking into account inputs including the current rotation speed and phase 162 of the rotatable shaft, the temperature 164, a measurement of the amount of entrained gas present in the hydraulic fluid 166, and (for each working chamber) the voltage at the LPV 168 and HPV 170, along with data specifying the history of previous decisions as to whether to carry out active or inactive cycles of working chamber volume on each cycle of working chamber volume.

One skilled in the art will appreciate that the estimate of pressure taking into account a plurality of factors other than the timing of LPV or HPV voltage pulses, or other signals indicative of movement of the LPV or HPV can be carried out in a number of different ways. A simple approach is to store a lookup table indicative of pressure as a function of LPV opening time with different values of other parameters and the algorithm may simply interpolate between those stored values. Alternatively, the algorithm may implement a multi-parameter mathematical model or (for example) be a machine learning algorithm previously trained on measurement date. The machine may be operated with a higher pressure gallery pressure sensor (a pressure test rig) in a calibration step during or after manufacture, to enable the calibration data 156 to be determined.

One factor which can significantly affect the relationship between opening phase and pressure is the compressibility of the hydraulic fluid. This is affected by the composition of the hydraulic fluid (both liquid and gas phase) and by temperature. Thus, the calculation of pressure typically needs to take into account or is specific for certain compositions of hydraulic fluid.

Figure 5A:
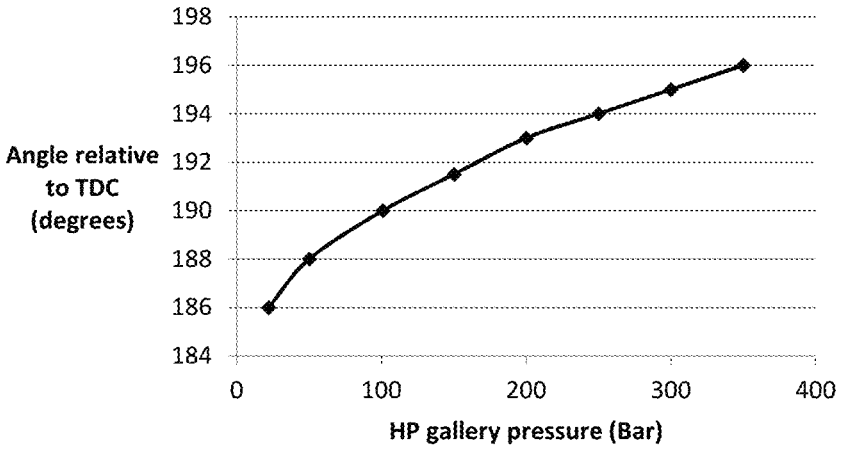
FIGS. 5A and 5B show experimentally obtained data linking LPV opening angle (y-axis) with HP gallery pressure (x-axis)
Figure 5B:
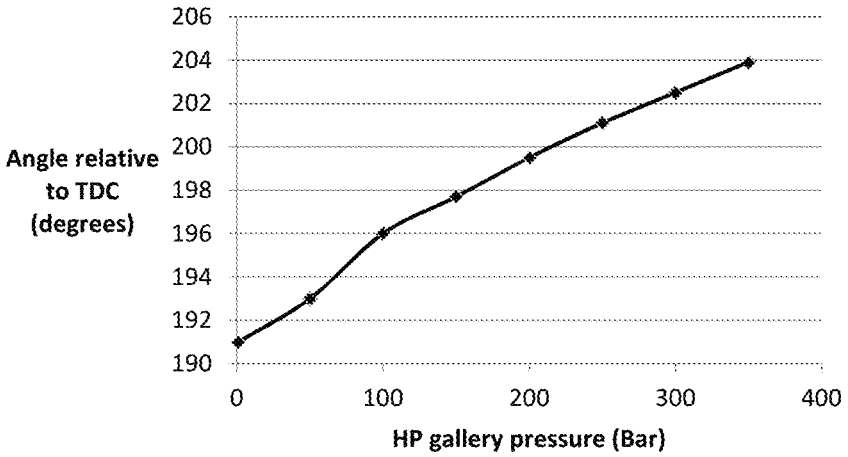

FIGS. 5A and 5B show the relationship between LPV opening phase (expressed as an angle relative to TDC) and pressure at two different speeds of rotation, controlling for all other parameters (temperature, hydraulic fluid composition etc). It is convenient to measure timing by measuring the phase of events, as this inaccuracies arising from small changes in speed of rotation. Nevertheless, events such as LPV opening will take place at phases which vary to some extent with speed of rotation. Even if a valve opening or closing takes the same period of time for example, that period represents a different change in phase depending on speed of rotation.

Figure 6:
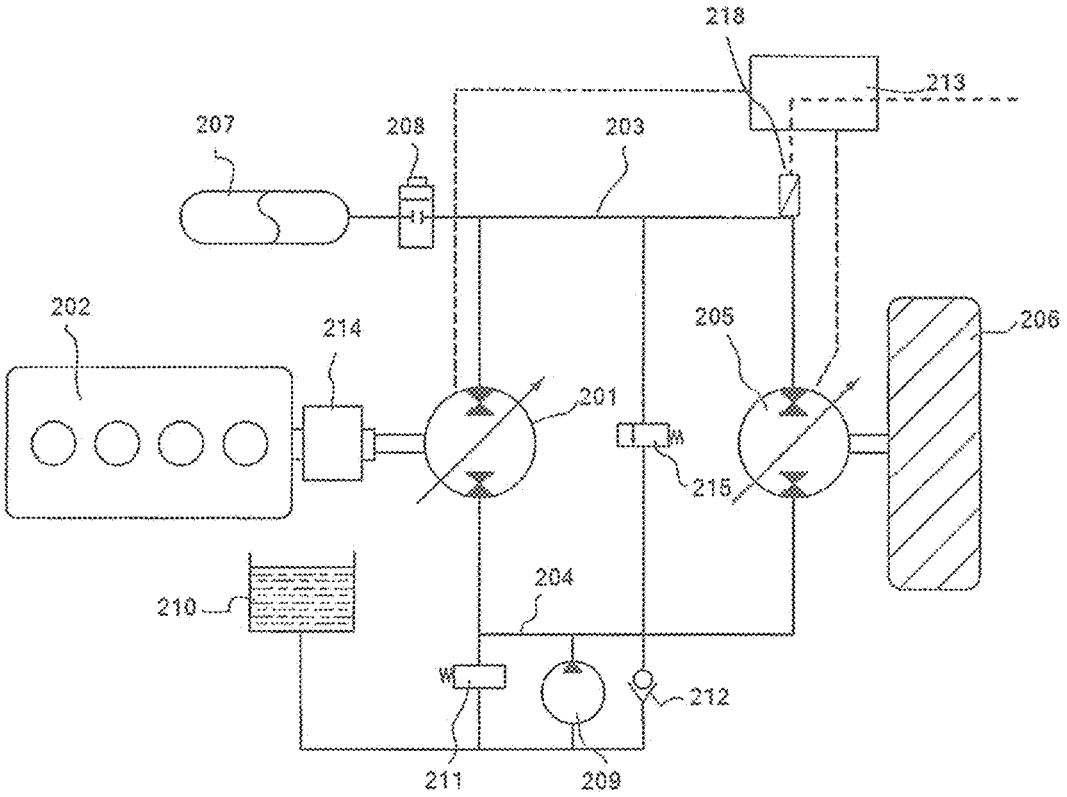
FIG. 6 is a schematic of a hybrid hydraulic transmission using the invention.

FIG. 6 illustrates an example application of the invention. FIG. 6 shows a schematic of a hybrid hydraulic transmission using the invention. A first hydraulic pump/motor 201 of the type shown in FIG. 1 is driven by internal combustion engine 202 through a reduction gearset and/or clutch 214. The first pump/motor includes a higher pressure gallery, connecting the HPVs of the first pump motor to a high pressure line 203 which delivers pressurised fluid to a higher pressure gallery of a second hydraulic pump/motor 205 also of the type described previously herein, which in turn drives at least one wheel 206. Fluid returns from (and in some modes, flows to) the second hydraulic motor via the low pressure line 204, which is raised slightly above atmospheric pressure by charge pump 209. A hydraulic accumulator stores energy in the form of high pressure fluid, and is selectively connectable to the high pressure line by controllable blocking valve 208. A low pressure relief valve 211 returns fluid exhausted from the accumulator to reservoir 210, while check valve 212 admits fluid to the low pressure line from the reservoir if the net flow to the accumulator exceeds the capacity of the charge pump 209 in use. A controller 213 coordinates the two hydraulic pump/motors and the blocking valve 208, as well as estimating the pressure in the high pressure line.

There are several modes of use of the hybrid hydraulic transmission just described, which are known in the art. Many of these modes comprise one or other of the pump/motors operating in the motoring mode and the other operating in pumping mode. For example there may be a normal operating mode in which the first pump/motor provides fluid which is consumed by the second pump/motor and used to drive the wheels 206, and a regenerative braking more in which the flow of energy is reversed.

Accurate knowledge of the pressure in the high pressure line is important to the control of such a transmission. It is necessary to maintain appropriate pressure in the high pressure line to enable sufficient torque to be delivered to the wheels and to enable brief mismatches in the amount of pressure delivered by the first pump/motor and consumed by the second pump/motor. The invention can be used by the methods set out above to estimate the pressure in the high pressure line from the timing of reopening of LPVs in the second pump/motor, while it is carrying out motoring cycles in the normal operating mode.

It is also possible to use the timing of the opening of the LPV to estimate the pressure in the higher pressure gallery or working chamber for a machine carrying out pumping cycles, such as the first pump/motor of the FIG. 5 example, in the normal operating mode. In this case, the HPV closes towards the end of the contracting stroke (just before TDC) or early in the expansion stroke (just after TDC), after fluid delivery to the high pressure fluid gallery. Again, the amount (mass) of hydraulic fluid thereby trapped in the working chamber depends on the pressure in the HP manifold and, again, the timing of the LPV opening early in the expansion stroke (just after TDC) depends on amount of working fluid present and so the cylinder working volume which is required before the chamber pressure drops sufficiently to drag the LPV open.

In some embodiments, pressure can be estimated from the timing of the closure of LPV, e.g. at the end of a contraction stroke of a pumping cycle, at around TDC. The timing of this event is related to the pressure in the working chamber when the HPV closes. Similarly, pressure can be estimated from the timing of the opening of the HPV, e.g. during a pumping cycle. The HPV opens when sufficient pressure has built up in the working chamber to overcome the forces holding the HPV shut, of which the predominant force is due to the pressure difference which is initially present between the higher pressure gallery and the interior of the working chamber. The timing of the HPV opening event therefore depends on the pressure in the higher pressure gallery, although it also depends on the amount of working fluid trapped in the working chamber when the LPV closes and seals. The timing of the closure of the HPV can also be indicative of pressure in the HP manifold. In the example given above, the HPV is closed under active control at a precisely controlled phase. However, in modes or embodiments where the HPV is allowed to close due to a change in pressure differential, for example at around TDC in a pumping cycle, the timing of the closing event is related to the pressure in the HP manifold.

More complex embodiments would consider, for example, the timing of the opening of pilot and/or main stages of valves having both independently operating pilot and main valves, for example those disclosed in EP 2064474 and EP 2329172.

Figure 7:
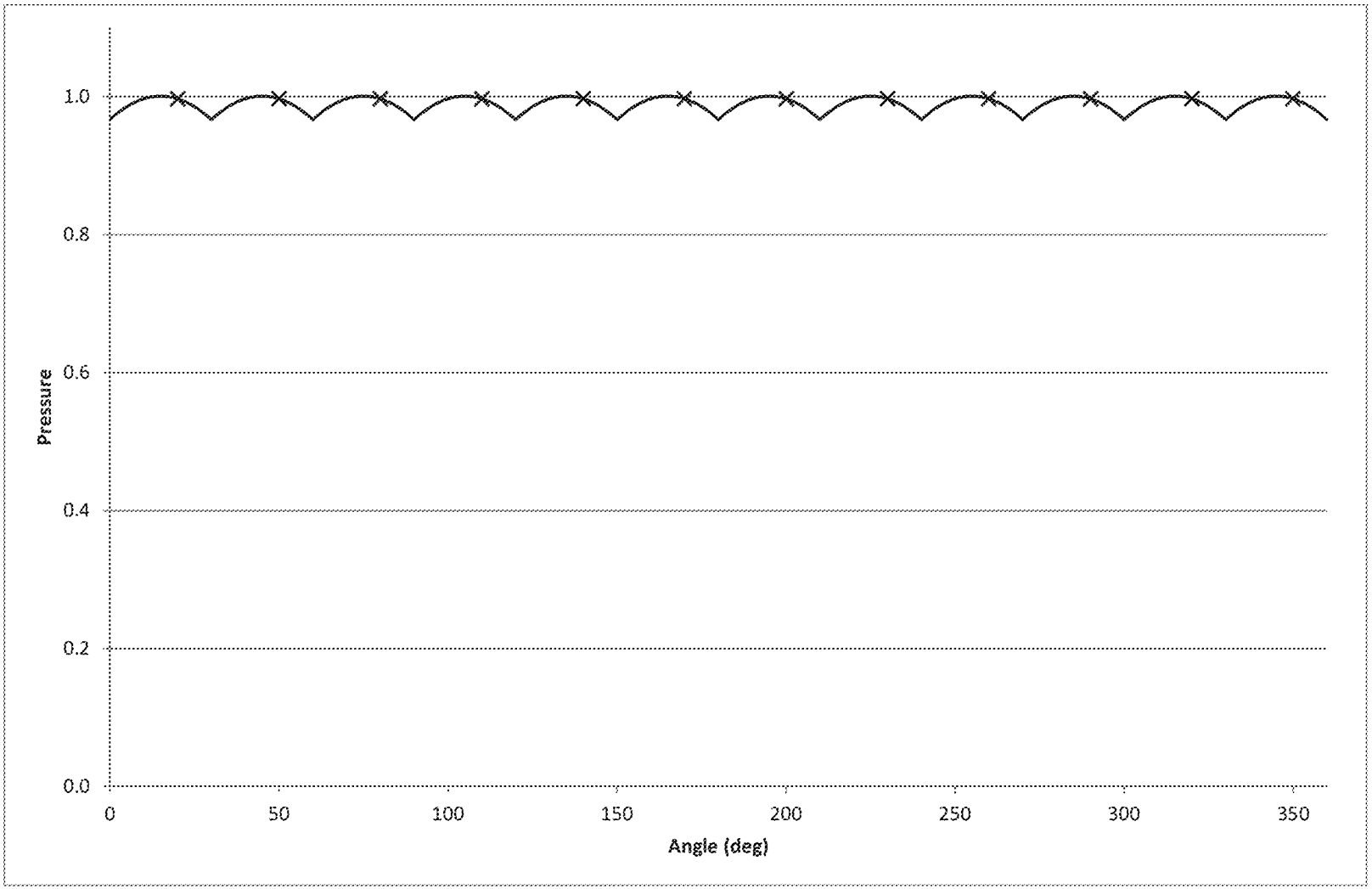
FIG. 7 illustrates the variation in pressure in the higher pressure gallery with time, at constant speed of rotation of the rotatable shaft.

In many embodiments, there are multiple working chambers, which have volume cycles which are phased apart, and that are connected between the same low pressure and high pressure fluid galleries. For example, a bank of n working chambers with LPVs and HPVs connected to the same lower pressure gallery and the same higher pressure gallery may be arranged around the rotatable shaft and phased apart (e.g. by 360/n degrees, or an integer multiple therefore in embodiments with multiple lobed cams, although even spacing is not required). N may for example be 4, 8, 10, 12, or 20 or more. In these cases, pressure in the higher pressure gallery can, if desired, be sampled multiple times per rotation of the rotatable shaft, while more than one working chamber is carrying out active cycles. If each working chamber carries out active cycles, pressure can be sampled during each cycle, at the same phase within each cycle. This is shown in FIG. 7. Nevertheless, there is a phase lag between the time at which pressure is sampled (by the closure of the HPV sealing the working chamber from the fluid galleries in the example of FIG. 3) and the time when the pressure measurement can be completed (when the LPV next opens thereafter).

By measuring the pressure at the same phase within each cycle, it may be possible to reject the pressure ripple, induced by the active cycles, from the measurement.

It is not necessary to measure pressure on every cycle. Pressure may for example be calculated form valve opening or closing measurement during only a subset of active cycles. Readings from opening or closing events during a plurality of cycles of the same or different working chambers Optionally, an active cycle (i.e. full or part stroke) may be carried out purely for the purpose of estimating the pressure. Preferably, the active cycle is a small part stroke in order to minimally influence the displacement.

Although in the examples herein the lower and higher pressure galleries remain at relatively low and high pressures in use, the invention also extends to embodiments in which the galleries may swap which is relatively lower and higher pressure during operation. Once the galleries swap, the valves which constitute the LPV and HPV also swap.

The invention enables pressure sensors to be dispensed with, reducing cost and wiring complexity, and providing one fewer component which might fail, where multiples of such components are installed per machine. Nevertheless, the invention is also useful as a backup in a machine which has a pressure sensor (e.g. for measuring higher pressure gallery pressure, or even one pressure sensor per working chamber), in case of failure of that component.

Further variations and modifications may be made within the scope of the invention herein disclosed.

The invention claimed is:

1. A method of estimating a pressure of hydraulic fluid in a fluid working machine, the fluid working machine comprising a working chamber of cyclically varying volume, a first hydraulic fluid gallery and a second hydraulic fluid gallery, a first valve which regulates the flow of hydraulic fluid between the working chamber and the first hydraulic fluid gallery, and a second valve which regulates the flow of hydraulic fluid between the working chamber and the second hydraulic fluid gallery, the method comprising:

detecting an event indicative of an opening or closing of the first valve to bring the working chamber into or out of fluid communication with the first hydraulic fluid gallery and estimating the pressure from a timing of the detected event.

2. A method according to claim 1, wherein the estimated pressure is the pressure of hydraulic fluid in the second hydraulic fluid gallery or in the working chamber when the working chamber is sealed from both the first and second hydraulic fluid galleries.

3. A method according to claim 1, wherein the first hydraulic fluid gallery is a lower pressure gallery and the second hydraulic fluid gallery is a higher pressure gallery.

4. A method according claim 1, wherein the first valve comprises a valve member and the event indicative of the opening or closing of the first valve is a physical movement of the valve member, said movement detected by a sensor.

5. A method according to claim 4, wherein the event indicative of the opening or closing of the first valve is a generation of an electrical signal resulting from movement of the valve member.

6. A method according to claim 5, wherein the first valve is a solenoid valve having a solenoid comprising a movable armature coupled to the valve member and comprising a solenoid coil, and the electrical signal is induced in the solenoid coil by movement of the armature relative to the solenoid coil due to movement of the valve member.

7. A method according to claim 1, wherein the opening or closing of the first valve is the opening of the first valve caused by a reduction in pressure in the working chamber during an expansion stroke.

8. A method according to claim 1, wherein the opening or closing of the first valve is the closing of the first valve caused by a reduction in pressure in the working chamber during an expansion stroke.

9. A method according to claim 1, wherein the timing is a phase, within cycles of working chamber volume, of the event.

10. A method according to claim 1, wherein the estimation of the pressure takes into account the timing of the detection of the event during only some cycles of working chamber volume.

11. A method according to claim 1, wherein the estimation of the pressure from the timing of the detected event takes into account at least one other parameter.

12. A method according to claim 11, wherein the estimation of the pressure from the timing of the detected event takes into account properties of a hydraulic circuit portion in fluid communication with the first hydraulic fluid gallery.

13. A method according to claim 11, wherein the estimation of the pressure from the timing of the detected event takes into account a measurement of a position of, or load acting on, a hydraulic actuator in fluid communication with the first hydraulic fluid gallery.

14. A method according to claim 1, wherein the estimation of the pressure takes into account the timing of the detection of the event during active cycles in which the working chamber makes a net displacement of working fluid.

15. A method of estimating a pressure of hydraulic fluid in a fluid working machine, the fluid working machine comprising a first hydraulic fluid gallery and a second hydraulic fluid gallery, a plurality of working chambers which are in fluid communication with the first and second hydraulic fluid galleries, each working chamber having a first valve which regulates the flow of hydraulic fluid between its respective working chamber and the first hydraulic fluid gallery and a second valve which regulates the flow of hydraulic fluid between its respective working chamber and the second hydraulic fluid gallery, the method comprising:

detecting an event indicative of the opening or closing of one of the first valves to bring the respective working chamber into or out of fluid communication with the first hydraulic fluid gallery and estimating the pressure from a timing of the detected event.

16. A fluid working machine comprising:

a working chamber of cyclically varying volume, a first hydraulic fluid gallery and a second hydraulic fluid gallery, a first valve which is configured to regulate the flow of hydraulic fluid between the working chamber and the first hydraulic fluid gallery and a second valve which is configured to regulate the flow of hydraulic fluid between the working chamber and the second hydraulic fluid gallery, and a controller, the controller configured to estimate a pressure of working fluid in the fluid working machine by detecting and measuring a timing of an event indicative of an opening or closing of the first valve to bring the working chamber into or out of fluid communication with the first hydraulic fluid gallery and processing the timing of the detected event to estimate the pressure.

* * * * *